United States Patent [19]

Strom et al.

[11] Patent Number: 4,508,107

[45] Date of Patent: Apr. 2, 1985

[54] PNEUMATIC PERCUSSOR

[75] Inventors: Larry O. Strom, Fort Davis; Betty S. Guex, Dallas, both of Tex.

[73] Assignee: Strom Corporation, Dallas, Tex.

[21] Appl. No.: 417,602

[22] Filed: Sep. 13, 1982

[51] Int. Cl.[3] ..... A61H 7/00

[52] U.S. Cl. ..... 128/54

[58] Field of Search ..... 128/DIG. 10, 38–40, 128/50, 53–55, 28, 205.25, 64–66; 272/70; 91/39; 92/34.92, 93; 267/35, 153

[56] References Cited

U.S. PATENT DOCUMENTS

| | | | |
|---|---|---|---|
| 1,898,652 | 2/1933 | Williams | 128/64 X |
| 2,642,863 | 6/1953 | Gordon | 128/38 |
| 3,201,111 | 8/1965 | Afton | 5/449 X |
| 3,942,518 | 3/1976 | Tenteris et al. | 128/DIG. 10 X |
| 3,955,563 | 5/1976 | Maione | 128/53 |
| 4,003,374 | 1/1977 | Mizrachy | 128/50 X |
| 4,111,192 | 9/1978 | Wu | 128/38 |
| 4,196,722 | 4/1980 | Vanderwoude | 128/28 |
| 4,296,743 | 10/1981 | Lasley | 128/40 X |
| 4,297,999 | 11/1981 | Kitrell | 128/28 X |
| 4,361,140 | 11/1982 | Barkalow | 128/53 |

OTHER PUBLICATIONS

"Off the Drawing Board"; Strom Corporation; shown at A.A.R.T. Conv. in Dec., 1979.

"A Therapy is Born"; Cussionair Therapy Products, Inc.; P-N Jan./Feb., 1982.

*Primary Examiner*—Robert A. Hafer
*Assistant Examiner*—Chris Coppens
*Attorney, Agent, or Firm*—Richards, Harris, Medlock & Andrews

[57] ABSTRACT

A pneumatic percussor includes a three-way valve that is gated on by a control circuit (50) to gate compressed air from a compressor (10) to a percussor cup (70). The percussor cup (70) is a resilient bellows that is expandable in response to pressurized air that is gated through the three-way valve (28). A variable orifice (62) regulates the air flow to the percussor cup (70). A check valve (60) is connected in parallel with the variable orifice (62) to exhaust air to the atmosphere. The control circuit (50) gates the three-way valve on for a short duration during which the percussor cup (70) is inflated and when the control circuit (50) gates the three-way valve (28) off, the check valve (60) relieves the pressure from the inside of the percussor cup (70) to deflate it. The expansion and contraction of the percussor cup (70) delivers a therapeutic rhythmic action to the portion of the body external to the thoracic cavity thereby stimulating the expectoration of the mucus from the lungs.

3 Claims, 7 Drawing Figures

PNEUMATIC PERCUSSOR

TECHNICAL FIELD

The present invention pertains in general to therapeutic percussors and, more particularly, to a pneumatic percussor with a variable stroke and intensity.

BACKGROUND OF THE INVENTION

Percussors have been utilized as therapeutic devices to stimulate expectoration of mucus from the lungs. By stimulating the areas of the body adjacent to the thoracic cavity, mucus that lines the alveolar sacs of the lungs can be loosened and expectorated. The pressure within the alveolar sacs between inspiration and expiration is normally at atmospheric pressure. To expire, it is only necessary to create a positive pressure within the thoracic cavity that surrounds the lung thereby increasing the pressure within the alveolar sacs which results in deflation of the lungs or expiration. To inspire, the reverse occurs and a negative pressure is introduced into the thoracic cavity to cause the alveolar sacs to expand thus lowering the pressure within the alveolar sacs to draw air into the lungs. The action of a percussor on the outside of the thoracic cavity is sufficient to cause an undulation of the pressure within the thoracic cavity. This undulation is a rapid succession of impulses to the external walls of the thoracic cavity causing the pressure within the thoracic cavity to alternate between a slight negative and a slight positive pressure. This pressure variation is in turn relayed to the alveolar sacs which are interconnected by bronchioles such that a localized undulation to one section of the lungs is transferred or averaged out to the remaining alveoli. Since the percussor operates at a rate many times that of normal breathing, each of the alveolar sacs is in a sense resonated at the frequency of the percussor. This undulating action has proven to be helpful to patients suffering respiratory diseases by clearing up and reducing the amount of mucus that lines the inner walls of the alveoli.

There have been numerous types of percussors in the prior art such as the mechanically operated strobe percussor that consists of a reciprocating arm with a soft pad to produce a thumping on the chest. The motor for this mechanical percussor is contained in a hand unit, and as such, both increases the weight of the unit and the hazard that the patient's hair may be drawn into the motor. Since some patients can require many hours of use at one particular time, these types of percussors have proven impractical in that they must be held by hand as they are moved to different areas proximate to the thoracic cavity.

A pneumatic percussor which alleviates the cumbersome type of hand unit has been disclosed in U.S. Pat. No. 3,955,563 and illustrates a rubber suction cup that is attached to the end of a piston which is reciprocated in a sealed air cylinder. A control valve is operable to allow air to enter the cylinder thus extending the piston. The piston is retracted when the air supply is removed by closing the valve and a spring is operable to return the piston to a resting position. An oscillator is utilized to switch the valve on and off thereby increasing the pressure within the cylinder at the oscillator rate to provide a variable stroke rate per second. This type of percussor, although utilizing a pneumatic control, essentially results in the same type of movement that was present with the mechanical percussors.

It is desirable to have a percussor that is both lightweight with a variable stroke rate and yet provide a more gentle rhythmic motion for percussion therewith. The prior art devices fail to take into account the operator that handles the percussor since this may affect the absolute pressure that is applied to the thoracic cavity due to the fact that these percussors do not provide for any lateral dissemination of the forces therein.

BRIEF DESCRIPTION OF THE DRAWINGS

For a more complete understanding of the present invention and the advantages thereof, reference is now made to the following detailed description taken in conjunction with the accompanying drawings, in which.

SUMMARY OF THE INVENTION

The present invention disclosed and claimed herein is an apparatus for stimulating the expectoration of mucus from the lungs. An enclosed chamber fabricated of resilient material having an orifice at one end thereof is periodically connected to a pressurized air source by a solenoid operated three-way valve. A check valve is connected to the orifice in the enclosed chamber to regulate the flow of air through the orifice to the enclosed chamber. The check valve exhausts air to the environment at a finite air flow such that when the pressurized air source is connected to the orifice, the pressure within the sealed chamber contracts and the air flows through the check valve to the environment, thereby providing a rhythmic action to the lung.

In another aspect of the present invention, a pneumatic toggle valve is connected to a regulated air supply to control the three-way valve and is variable to produce an astable periodicity for controlling a three-way valve.

DETAILED DESCRIPTION OF THE INVENTION

Figure 1:
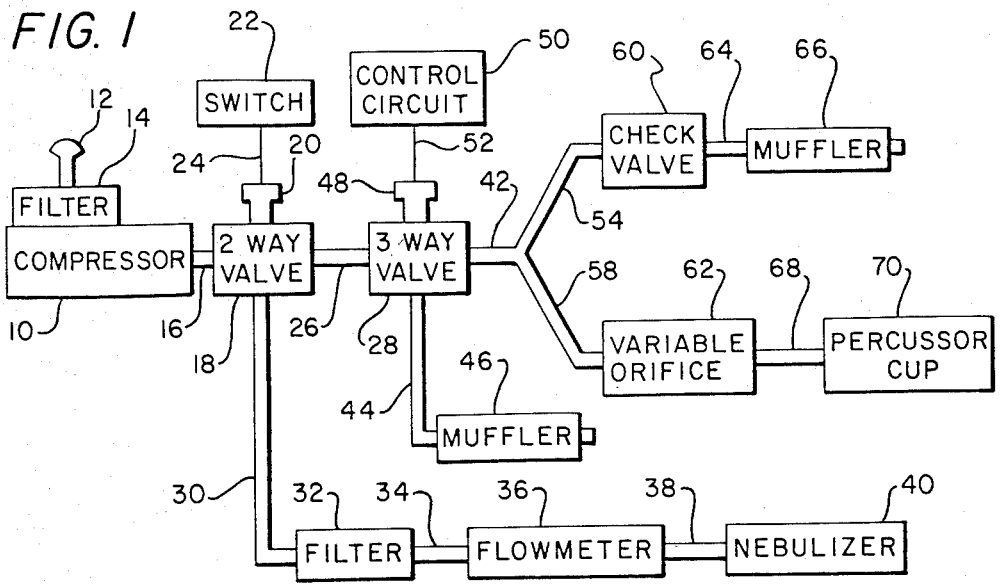
FIG. 1 illustrates a cross-sectional diagram of the present invention.
Figure 2A:
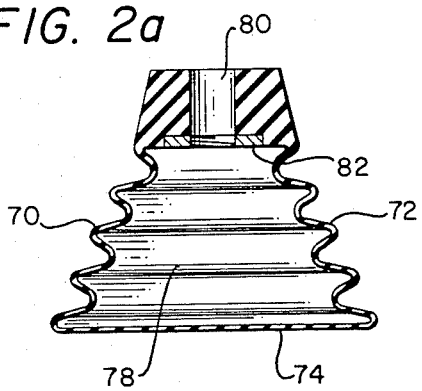
FIG. 2*a* illustrates a cross-sectional diagram of the bellows.
Figure 2B:
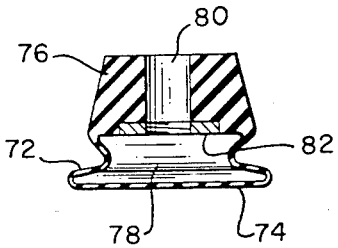
FIG. 2*b* illustrates a cross-sectional diagram of another version of the bellows.

Referring to FIG. 1, there is shown a schematic block diagram of the present invention. An air compressor 10 is operable to supply pressurized air to the system of FIG. 1 by drawing air from the surrounding environment through an inlet port 12 and filtering the air through a filter 14. The air is output to an air tube 16 that is input to a two-way valve 18. The two-way valve 18 has a solenoid 20 that operates a two-way valve to connect the input port to one of two output ports. A switch 22 is connected to the solenoid 20 by a control line 24. The switch is operable to energize the solenoid 20 thereby switching the two-way valve from one port to the other. The valve 18 can be switched back by de-energizing the solenoid 20 with the switch 22.

One output port of the two-way valve 18 is connected to an air tube 26 which has the other end thereof connected to the input port of a three-way valve 28. The other port of the two-way valve 18 is input to an air tube 30 that has the other end thereof connected to a filter 32. The two-way valve 18, when de-energized, connects the air tube 16 to the air tube 26 thus allowing a compressor 10 to pressurize the interior of the air tube 26. When the solenoid 20 is energized by activating the switch 22, the compressed air from the compressor 10 is diverted to the interior of the tube 30 and to the filter 32.

The output of the filter 32 is connected to an air tube 34 which has the other end thereof connected to a flow meter 36. The output of the flow meter 36 is connected to an air tube 38 which has the other end thereof connected to a nebulizer 40. The nebulizer 40 is operable to supply a vaporized medicated mist to a patient to aid in the expectoration of mucus from the lungs.

The three-way valve 28 has one output thereof connected to an air tube 42 and the other output thereof connected to the input of an air tube 44. The other end of the air tube 44 is connected to a muffler 46 which exhausts air to the surrounding environment. The three-way valve 28 is operated by a solenoid 48 in conjunction with a control circuit 50 which is connected to the solenoid 48 by a control line 52. The control circuit 50 is operable to energize and de-energize the solenoid 48 to control the three-way valve 28. The three-way valve 28 is of the type "113B-601B 12/DC," a solenoid valve manufactured by MAC of Wixom, Mich.

The other end of the air tube 42 is connected to two branching air tubes 54 and 58. The other end of the branching air tube 54 is connected to a check valve 60 and the other end of the branching air tube 58 is connected to a variable orifice 62. A connecting air tube 64 connects the output of the check valve 60 to the input of a muffler 66. It should be understood that the muffler 66 can be connected directly to the check valve 60 without the addition of the air tube 64. The output of the variable orifice 62 is connected to an air tube 68, the other end of which is connected to a percussor cup 70.

When the two-way valve 18 has the solenoid 20 de-energized such that the pressurized air from the compressor 10 is diverted to the input of the three-way valve 28, the system of FIG. 1 is in the percussor mode. By switching the switch 22, thus energizing the solenoid 20, the air from the compressor 10 is thereby diverted to the nebulizer 40. This allows the operator to choose two modes of operation, one for a nebulizer function and one for a percussor function. The following description of the operation of the percussor of the present invention requires that the two-way valve 18 have the solenoid 20 de-energized such that the air from the compressor 10 is routed to the input of the three-way valve 28. The control circuit 50 provides a control signal along the control line 52 that provides electronic pulses having approximately a 20% duty cycle. The frequency of the pulse train that is output by the control circuit 50 is internally variable, as will be discussed hereinbelow, over a range of 300 to 2,000 pulses per minute.

With a duty cycle of 20%, the three-way valve 28 routes the air from the compressor 10 to the air tube 42 during 20% of the period of the pulse train output by the control circuit 50. For the remaining 80% of the duty cycle, the three-way valve diverts the air flow from the compressor 10 to the muffler 46 and exhausts the air to the environment. When the air from the compressor 10 is input to the tube 42, a dynamic system is encountered that changes as a function of pressure, air flow and duration of the connection of the compressor 10 to the air tube 42. In order to understand the operation of the circuit, it is necessary to briefly describe the operation of the percussor cup 70. The detailed description of the percussor cup is contained hereinbelow.

The percussor cup 70 is operable to expand in response to an increase in air pressure within the air tubes 42, 58 and 68. When pressure is removed from the air hoses 42, 58 and 68, the percussor cup 70 is operable to contract, thus reducing the pressure therein. This is a dynamic system that is constantly changing in response to the operation of the three-way valve 28.

When the pressurized air from the compressor 10 is initially routed to the air tube 42, the pressure within the air tubes 42, 54, 58 and 68 begins to increase. The check valve 60 is operable to activate at a pressure of approximately one pound per square inch (psi) and, at this pressure, the air within the air tube 54 is allowed to flow through the check valve 60, the air tube 64 and to the environment through the muffler 66. However, it is important to understand that the check valve has a finite orifice that restricts the flow of air therethrough depending upon the pressure in the air tube 54 and the atmospheric pressure. When the pressure initially increases in the tube 42, the percussor cup 70, which is a sealed chamber, begins to expand to relieve the pressure within the air tube system consisting of the air tubes 42, 54, 58 and 68. When the pressure increases to a pressure of one pound per square inch, the check valve 60 opens and allows air within the air tube 54 to exhaust to the atmosphere. Since there is a finite orifice in the check valve 60, the pressure within the air tube 54 is maintained at a higher level than one psi due to the volumetric air flow output by the compressor 10. During the time that the pressurized air from the compressor 10 is connected to the air tube 42, the air flows both through the air tube 54 and the air tube 58. The flow of air is regulated by the finite orifice that is inherent to the check valve 60 and the variable orifice 62. The variable orifice 62 is operable to restrict the air flow from the air tube 68 to the percussor cup 70. If the variable orifice 62 is adjusted to restrict flow to the percussor cup 70, then a higher back pressure is built up in the air tube 58 resulting in an increased air flow through the check valve 60 due to the resultant increase in back pressure in the air tube 54. It should be understood that the pressure within the air tubes 42, 54 and 58 is equilibriated as the air tubes are common to each other.

When the signal from the control circuit 50 diverts the flow through the three-way valve to exhaust from the muffler 46, the pressure within the air tubes 42, 54 and 58 is allowed to exhaust through the check valve 60 since the pressure therein is greater than one psi. At the beginning of this cycle which is termed the "exhaust" cycle, the pressure within the air tubes 42, 54 and 58 is still greater than the pressure within the percussor cup 70 and the system is allowed to equalize. This equalization allows some air flow to exhaust to the atmosphere through the check valve 60 and allows some additional air flow to pass through the variable orifice 62 to the percussor cup 70. Since the volume of air within the air tubes 42, 54 and 58 is relatively small, this equalization occurs very rapidly. It should be understood that the capacity of the air tubes 42, 54 and 58 in conjunction with the size of the orifice in the check valve 60 and the variable orifice 62 determines the expansion time for the percussor cup 70. After equalization, the air contained within the percussor cup 70 reverses air flow and flows from the percussor cup 70 through the variable orifice 62 to the air tube 58. This is due to the fact that the pressure within the air tubes 42, 54 and 58 is reduced due to exhausting through the check valve 60. When the pressure within the air tube 58 is negative with respect to the pressure within the percussor cup 70, the percussor cup 70 exhausts therethrough. The variable orifice 62 in conjunction with the size of the orifice in the check valve 60 regulates the rate of flow or the rate of exhaust from the percussor cup 70. In this configuration, the variable orifice 62 and the orifice in the check valve 60 are connected in series whereas in the pressurization cycle, or the "on" cycle for the percussor, the orifice in the check valve 60 and the orifice in the variable orifice 62 are in parallel operation. The percussor cup 70 exhausts air through the variable orifice and out the check valve 60 until the pressure within the percussor cup 70 is reduced to one psi or below, thereby closing the check valve 60.

The result of connecting the pressurized air from the compressor 10 to the air tube 42 is that the percussor cup 70 is allowed to expand during the "on" cycle and is allowed to contract during the "exhaust" cycle. By varying the frequency of the pulse train output of the control circuit 50, the expanding and contracting of the percussor cup 70 can be varied. In an important aspect of the present invention, the compressor 10, the two-way valve 18 and the three-way valve 28 with the associated control circuit 50 and the muffler 46 are disposed a distance away from the actual percussor cup 70. The variable orifice 62 is normally mounted in close proximity to the percussor cup 70. This allows the percussor cup 70 to be hand operated a distance away from the compressor 10 to provide a light-weight unit that is relatively quiet and safe. The only sound that is perceivable by a patient and/or an operator is the sound produced by the air flowing through the variable orifice 62 and the perturbation of the air surrounding the percussor cup 70.

Referring now to FIG. *2a*, there is shown a cross-sectional diagram of the percussor cup 70. The percussor cup 70 is fabricated from a resilient material such as rubber and is configured as a frustrum shaped bellows having pleated sides. The cup 70 has a bottom surface 74 that provides one sealing surface and a supporting structure 76 that, in combination with the sides 72 and the bottom 74, provides an enclosed chamber 78. An orifice 80 allows air to be pumped into the enclosed chamber 78 from an external source, as will be described hereinbelow. A non-corrosive nut 82 is molded into the supporting structure such that the cup 70 can be attached to a supporting device (not shown). Since the sides 72 and the bottom 74 are fabricated of the same resilient material, an increase in pressure within the enclosed chamber 78 provides two functions. The first function is that the bottom expands downward along the longitudinal axis of the frustrum thereby expanding the pleated sides 72 and when the pressure is released the reverse action takes place. If an object is encountered by the bottom surface 74, the pleated sides 72 react to provide a lateral movement thereby allowing the enclosed chamber 78 to expand in volume laterally rather than longitudinally. This feature is an important aspect of the present invention since an operator pressing the cup 70 on a specified area external to the thoracic cavity sometimes varies the pressure with which the cup 70 is pressed against the patient. The expansion of the sides 72 provides a damping effect to average out the perturbations in the hand pressure of the operator.

Referring now to FIG. *2b*, there is illustrated a cross-sectional diagram of an alternate design for the percussor cup 70 wherein like numerals refer to like parts in the various figures. It can be seen when comparing the cup of FIG. *2b* with the cup of FIG. *2a*, the only difference is that there is only one pleated edge separating the two as compared to the multiple pleats on the edges 72 of FIG. *2a*. The single pleated edge restricts the movement of the bottom surface 74 thereby providing a smaller displacement device. As described above with reference to FIG. 1, if the air pressure within the percussor cup 70 increases to a level equal to that within the air tubes 42, 54 and 58, the amount of air diverted to the check valve 60 and exhausted by the muffler 66 is increased. This is due to the fact that the pressure within the enclosed chamber 78 of FIG. *2b* increases rapidly as compared to the chamber 78 of FIG. *2a*.

Figure 3:
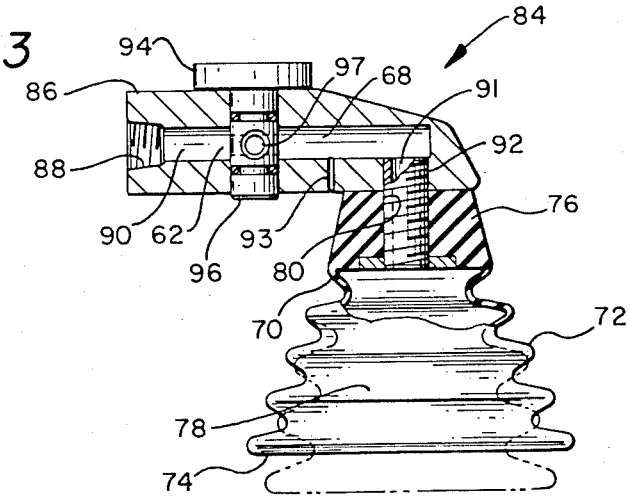
FIG. 3 illustrates a cross-sectional diagram of the pulsor head with the bellows attached depicting two positions of the bellows.

Referring now to FIG. 3, there is illustrated a cross-sectional diagram of a percussor head 84 that is equivalent to the variable orifice 62, the connecting air tube 68 and the percussor cup 70 of FIG. 1, wherein like numerals refer to like parts in the two figures. A supporting structure 86 has a threaded socket 88 for attachment to the air tube 58 of FIG. 1. An air duct 90 connects the threaded socket 88 with the variable orifice 62. An air relief hole 93 connects the air duct 90 to atmospheric pressure. The connecting air tube 68 is also internal to the percussor head 84 and connects the variable orifice 62 with the orifice 80 in the percussor cup 70. A threaded insert 92 threadedly engages with the nut 82 and the structure 86 to attach the percussor cup 70 to the structure 86. An orifice 91 through the threaded insert 92 allows communication between the connecting tube 68 and the enclosed chamber 78 of the percussor cup 70.

A valve 94 is operable to rotate an extended member 96 having an orifice 97 through the center, as represented by phantom lines, to connect the tubes 90 and 68 together. As this orifice 97 is rotated, the cross-sectional area of the orifice is reduced thereby providing an increasing restriction with decreasing surface area. The orifice 97, the member 96 and the valve 94 comprise the variable orifice 62 of FIG. 1. The valve utilized for the valve 94 is a plug valve assembly, part No. B-P4T-K9, manufactured by Nupro, Willoughby, Ohio. By turning the valve 94 in either direction, the restriction introduced between the air tubes 90 and 68 can be adjusted, thereby adjusting the rate of air flow therethrough to the enclosed chamber 78.

The operation of the percussor cup 70 is illustrated by a set of phantom lines showing the percussor cup 70 in an expanded configuration. As described above, when there is no restraining force against the bottom surface 74 of the percussor cup 70, the movement is along the longitudinal axis of the frustrum. If a force is incurred by the bottom surface 74, the movement of the sides 72 is expanded laterally to reduce the downward force of the bottom surface 74.

Figure 4:
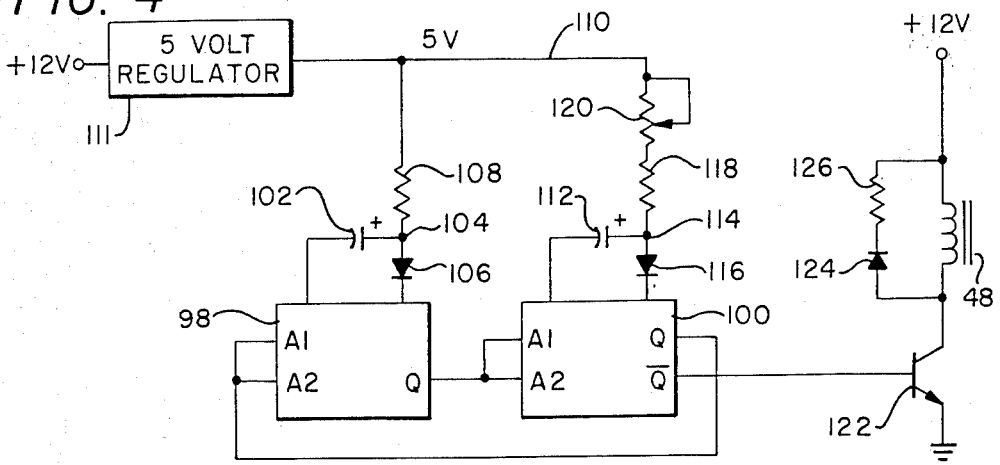
FIG. 4 illustrates a schematic of the multivibrator circuit for gating the three-way valve.

Referring now to FIG. 4, there is shown a schematic diagram of the control circuit 50 that is attached to the solenoid 48 to provide the periodic gating of the three-way valve 28. Retriggerable monostable multivibrators 98 and 100 are connected in a configuration to provide an asymmetric duty cycle output. The multivibrators 98 and 100 are of the type 74122 manufactured by Texas Instruments, Inc.

A polarized capacitor 102 has the negative input thereof connected to the capacitive input of the multivibrator 98 and the positive input thereof connected to a node 104. A diode 106 has the cathode thereof connected to the resistor/capacitor input of the multivibrator 98 and the anode thereof connected to the node 104. A resistor 108 has one end thereof connected to the node 104 and the other end thereof connected to a power supply terminal 110. The power supply terminal 110 is connected to a +5 V supply through a voltage regulator 111 connected to a +12 V supply. A polarized capacitor 112 has the negative input thereof connected to the capacitive input of the multivibrator 100 and the positive input thereof connected to a node 114. A diode 116 has the cathode thereof connected to the resistor/capacitor input of the multivibrator 100 and the anode thereof connected to the node 114. A resistor 118 has one end thereof connected to the node 114 and the other end thereof connected to one end of a potentiometer 120. The other end of the potentiometer 120 is connected to the wiper thereof and to the node 110 to provide a variable resistor function.

The capacitor 102 and the resistor 108 provide the timing function for the multivibrator 98 and the capacitor 112, the resistor 118 and the potentiometer 120 provide the timing components for the multivibrator 100. The Q output of the multivibrator 98 is connected to both the A1 and A2 inputs of the multivibrator 100. The Q output of the multivibrator 100 is connected in feedback to the A1 and A2 terminals of the multivibrator 98. In this configuration, the multivibrator 98 provides a positive going pulse on the Q output thereof as determined by the capacitor 102 and the resistor 108 and the $\overline{Q}$ output of multivibrator 100 is activated when the pulse on the Q output of the multivibrator 98 undergoes a negative transition. When the Q output of the multivibrator 100 undergoes a negative transition, that is, at the end of the pulse width determined by the capacitor 112, the resistor 118 and the potentiometer 120, the multivibrator 98 is again retriggered. Therefore, the output on the $\overline{Q}$ output of the multivibrator 100 is positive during the duration of the pulse output on the Q output of the multivibrator 98 and is negative for a duration determined by the capacitor 112, the resistor 118 and the potentiometer 120. This duration can be adjusted by adjusting the potentiometer 120.

A transistor 122 has the base thereof connected to the $\overline{Q}$ output of the multivibrator 100, the emitter thereof connected to ground and the collector thereof connected to one end of the solenoid 48. The other end of the solenoid 48 is connected to a +12 V supply. A diode 124 has the anode thereof connected to the collector of the transistor 122 and the cathode thereof connected to one end of the resistor 126. The other end of the resistor 126 is connected to the positive supply terminal 110.

The transistor 122 is operable to drive the solenoid into an energized state when the output on the $\overline{Q}$ output of the multivibrator 100 is positive, that is, during the duration of the multivibrator 98 pulse output. Therefore, the capacitor 102 and the resistor 108 attached to the multivibrator 98 determine the "on" cycle for the three-way valve 28 and the capacitor 112, the resistor 118 and the potentiometer 120 determine the duration of the "exhaust" cycle for the valve 28. The "exhaust" cycle is adjustable by the potentiometer 120 whereas the "on" time is not adjustable. It should be understood that the inclusion of a potentiometer between the resistor 108 and the positive supply terminal 110 is sufficient to allow adjustment of the "on" time.

Figure 5:
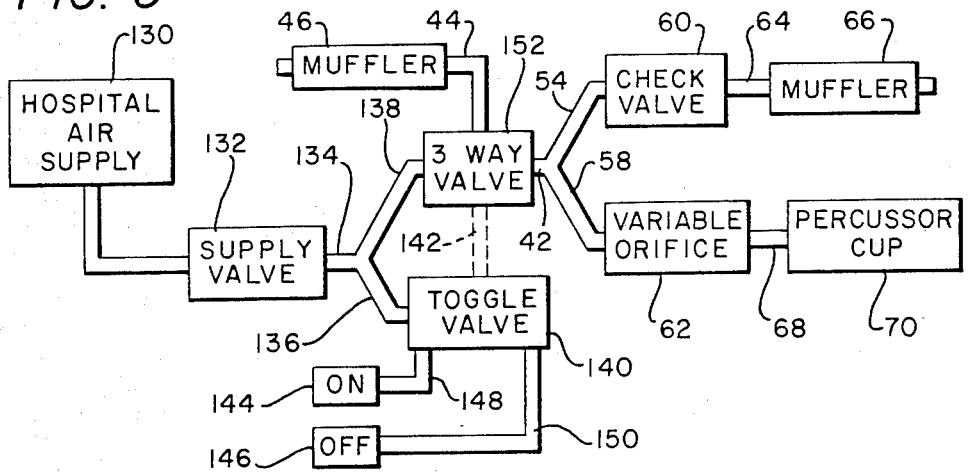
FIG. 5 illustrates a schematic block diagram of an alternate embodiment of the present invention.

Referring now to FIG. 5, a schematic block diagram of an alternate embodiment of the present invention is illustrated. A hospital air supply 130 that is regulated to about 50 psi is utilized and can be found in most rooms where therapeutic treatment of patients is undertaken. The type of air supplied by the hospital air supply 130 is connected to an air tube 134. The other end of the air tube 134 is connected to two branching air tubes 136 and 138. The other end of the branching air tube 136 is connected to a toggle valve 140 that is operable to pneumatically toggle a mechanical linkage 142. An "ON" control mechanism 144 and an "OFF" control mechanism 146 are pneumatically connected to the toggle valve 140 through air tubes 148 and 150 to provide control of the toggle valve 140.

The other end of the branching air tube 138 is connected to the input of a three-way valve 152. The three-way valve 152 is mechanically interconnected to the toggle valve 140 through the mechanical linkage 142. One output of the three-way valve 152 is connected to the air tube 42 and the other output thereof is connected to the air tube 44. The components attached to the other end of the air tubes 42 and 44 are identical to those components of FIG. 1.

The toggle valve 140 is operable to toggle the three-way valve 152 to route air from the hospital air supply to the air tube 42 as determined by the control mechanism 144. The control mechanism 146 determines the length of time that the hospital air supply is disconnected from the tube 44 and exhausted through the muffler 46.

Figure 6:
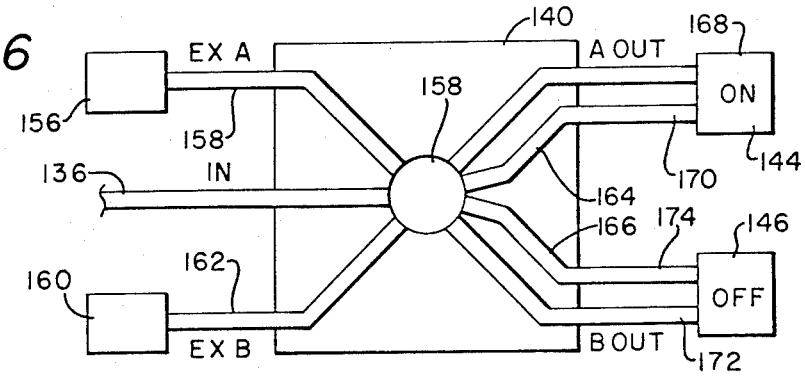
FIG. 6 illustrates a cross-sectional diagram of the valve for the embodiment of FIG. 5.

Referring now to FIG. 6, there is shown a schematic diagram of the toggle valve 140 of FIG. 5. The toggle valve 140 is a four-way valve that has an input port labeled "IN", a first output port labeled "AOUT", a second output port labeled "BOUT", a first exhaust port labeled "EXA" and a second exhaust port labeled "EXB". A spindle 154 internal to the four-way valve 140 is operable to direct the flow of air from the IN port to either the AOUT or the BOUT port. When either the AOUT or BOUT port is not connected to the IN port, they are connected to the EXA and the EXB port, respectively. These are exhaust ports and a muffler 156 is connected to the EXA port by a connecting tube 158 and a muffler 160 is connected to the EXB port by a connecting tube 162. The spindle 154 is controlled by a control port for each of the orientations. A control port 164 controls the operation of the spindle to direct air that is input to the IN port to the BOUT port and a control port 166 controls the spindle 154 to direct air that is input to the IN port to the AOUT port.

The ON control mechanism 144 is connected to the AOUT port by a connecting tube 168 and is also connected to the control port 166 by a connecting tube 170. The OFF control mechanism 146 is connected to the BOUT port by a connecting tube 172 and is also connected to the control port 166 by a connecting tube 174. The ON control mechanism 144 and the OFF control mechanism 146 are essentially pilot valves that are variable to adjust the flow of air that travels from the respective output port to the respective control port.

The operation of the toggle valve 140 will be described hereinbelow with reference to FIG. 6. Initially the spindle 154 is connected to either the BOUT or the AOUT port and for purposes of explanation it will be considered to initially be connected to the AOUT port. In this condition, the BOUT port is connected to the EXB port thereby relieving any pressure within the tube 172 or the tube 162. However, the pressurized air that is delivered to the tube 136 from the hospital air supply 130 is routed to the connecting tube 168 and passed through the ON control mechanism 144 to the control port 164. When a sufficient pressure has built up in the tube 170 that is the result of pressurized air flowing through the connecting tube 168 and through the valve 144 to the tube 170, the spindle valve 154 rotates and connects the IN port to the BOUT port at the same time that the AOUT port is connected to the EXA port. At this point, the pressure within the tube 168 is exhausted out through the muffler 156 and the pressure within the connecting tube 172 is increased. This increase in pressure in tube 172 causes an air flow through the valve 146 that pressurizes the connecting tube 174. When a sufficient amount of air has passed through the OFF control mechanism 146, the pressure delivered to the control port 166 is sufficient to again rotate the spindle 154 back to the original position.

The purpose of the ON control mechanism 144 and the OFF control mechanism 146 is to present a series impedance into the air flow path between the output ports AOUT and BOUT and the control ports 164 and 166, respectively. By adjusting the size of the orifice within the control mechanisms 144 and 146, the duration that the spindle 154 occupies in a given position can be adjusted. The control mechanisms 144 and 146 are equivalent to the resistor 108 and the resistor combination 118 and 120 of FIG. 4. This results in a pneumatic astable multivibrator having an asymmetric duty cycle, each half of the duty cycle controlled by the control mechanisms 144 and 146 individually. The three-way control valve 152 is mechanically connected to the spindle 154 by a similar spindle that is internal to the three-way valve 152 (not shown). This allows the toggle valve 140 to operate off of the hospital air supply, which presents approximately 50 psi of regulated pressure, thereby simplifying the operation and the size of the unit that must be moved from one patient to another.

In summary, a device has been disclosed that provides a resilient bellows that is rhythmically expanded and contracted in a controlled method to provide a stimulating effect external to the thoracic cavity. The rubber bellows along with the supporting head are the only portions of the present system that must be handled by the operator. The remaining portions of the system are external and are connected to the supporting head by a length of vinyl tube. In addition, the particular design of the rubber bellows allows an operator to vary the vertical pressure thereon without causing a significant degree of variation in the desired effect.

Although the preferred embodiment of the invention has been described in detail, it should be understood that various changes, substitutions and alterations can be made therein without departing from the spirit and scope of the invention as defined by the appended claims.

We claim:

1. An apparatus for stimulating expectoration of mucus from the lungs, comprising:

a sealed chamber having expandable resilient side and bottom walls to facilitate expansion, said chamber having an orifice in the surface thereof, and said chamber including rigid supporting structure disposed to constrain said side wall at an end thereof such that said side and bottom walls are uniformly free to flex in response to changes in air pressure within the chamber;

a pressurized air source;

means for regulating the air flow through the orifice in said chamber;

an air tube having one end connected to said means for regulating;

means for periodically connecting and disconnecting said pressurized air source to the other end of said air tube;

means for exhausting the air from said air tube such that said means for exhausting reduces the pressure within said air tube when said pressurized air source is connected and exhausting air within said chamber when said pressurized air source is not connected wherein said sealed chamber expands and contracts thereby producing a rhythmic movement to the lungs; and said means for periodically connecting comprising:

a pneumatically operated toggle valve controlled from said pressurized air source for toggling a linkage; and a three-way valve controlled by said linkage having the input thereof connected to said pressurized air source, one output thereof connected to said air tube and the other output thereof connected to a muffler.

2. An apparatus for stimulating expectoration of mucus from the lungs, comprising:

a frustrum shaped sealed chamber having a smooth surface on the larger end thereof and an orifice through the smaller end thereof, the sides of said chamber pleated to provide a bellows like movement longitudinally and radially about the longitudinal axis thereof, said sealed chamber being fabricated from a resilient material;

an air compressor for providing pressurized air;

a plug valve having one end thereof connected to the orifice in said sealed chamber;

an air tube connected to the other end of said plug valve such that said plug valve varies the cross-sectional area of the air passageway between said air tube and the orifice in said chamber;

a solenoid operated three-way valve having the input thereof connected to said compressor, one output thereof connected to the other end of said air tube and the other output connected to a muffler for exhausting air to the environment;

circuit means connected to said solenoid operated three-way valve to control which of the outputs thereof are connected to said compressor, said circuit means having a duty cycle that closes said solenoid operated valve to connect said pressurized air source to said tube for a first predetermined duration of time and disconnect said pressurized air source from said air tube for a second preset duration of time; and a check valve having one end thereof connected to said air tube between said solenoid operated three-way valve and said plug valve and the other end thereof connected to a muffler for exhausting air to the environment, said check valve operable to open at a predetermined pressure and having a finite orifice therein, wherein air from said compressor both flows into said sealed chamber and exhausts through said check valve to inflate said sealed chamber during the duration that said pressurized air source is connected to said air tube and air within said chamber exhausts through said check valve when said pressurized air source is disconnected from said air tube thereby reducing the pressure within said sealed chamber.

3. An apparatus for stimulating expectoration of mucus from the lungs, comprising:

a frustrum shaped sealed chamber having a smooth surface on the larger end thereof and an orifice through the smaller end thereof, the sides of said chamber pleated to provide a bellows like movement longitudinally and radially about the longitudinal axis thereof, said sealed chamber being fabricated from a resilient material;

a plug having one end thereof connected to the orifice in said sealed chamber;

an air tube connected to the other end of said plug valve such that said plug valve varies the cross-sectional area of the air passageway between said air tube and the orifice in said chamber;

a solenoid operated three-way valve having the input thereof for receiving an external regulated air supply, one output thereof connected to the other end of said air tube and the outer output connected to a muffler for exhausting air to the environment;

circuit means connected to said solenoid operated three-way valve to control which of the outputs thereof are connected to said regulated air supply, said circuit means having a duty cycle that closes said solenoid operated valve to connect said air supply to said tube for a first predetermined duration of time and disconnect said pressurized air source from said air tube for a second preset duration of time; and a check valve having one end thereof connected to said air tube between said solenoid operated three-way valve and said plug valve and the other end thereof connected to a muffler for exhausting air to the environment, said check valve operable to open at a predetermined pressure and having a finite orifice therein, wherein air from said compressor both flows into said sealed chamber and exhausts through said check valve to inflate said sealed chamber during the duration that said air supply is connected to said air tube and air within said chamber exhausts through said check valve when said air supply is disconnected from said air tube thereby reducing the pressure within said sealed chamber.

* * * * *